US008241518B2

(12) United States Patent
Igarashi et al.

(10) Patent No.: US 8,241,518 B2
(45) **Date of Patent: *Aug. 14, 2012**

(54) SOFT MAGNETIC MATERIAL AND DUST CORE

(75) Inventors: Naoto Igarashi, Itami (JP); Takao Nishioka, Itami (JP); Yoshiyuki Shimada, Itami (JP); Tsuyoshi Akao, Aichi (JP)

(73) Assignees: Sumitomo Electric Industries, Ltd., Osaka (JP); Denso Corporation, Aichi (JP); Sumitomo Electric Sintered Alloy, Ltd., Okayama (JP)

( * ) Notice: Subject to any disclaimer, the term of this patent is extended or adjusted under 35 U.S.C. 154(b) by 601 days.

This patent is subject to a terminal disclaimer.

(21) Appl. No.: 12/300,893

(22) PCT Filed: May 15, 2007

(86) PCT No.: PCT/JP2007/059950

§ 371 (c)(1),
(2), (4) Date: Nov. 14, 2008

(87) PCT Pub. No.: WO2007/138853

PCT Pub. Date: Dec. 6, 2007

(65) Prior Publication Data

US 2009/0197782 A1 Aug. 6, 2009

(30) Foreign Application Priority Data

May 30, 2006 (JP) ..... 2006-150095

(51) Int. Cl.
*H01F 1/26* (2006.01)
*C10M 129/68* (2006.01)

(52) U.S. Cl. ..... 252/62.54; 508/367; 508/539; 427/127; 252/62.55

(58) Field of Classification Search ..... 508/367, 508/539; 252/62.54, 62.55; 427/127
See application file for complete search history.

(56) References Cited

U.S. PATENT DOCUMENTS

| | | | | |
|---|---|---|---|---|
| 7,258,812 | B2 * | 8/2007 | Shimada et al. | 252/62.55 |
| 7,678,174 | B2 * | 3/2010 | Tokuoka et al. | 75/252 |
| 2004/0258552 | A1 * | 12/2004 | Shimada et al. | 419/30 |

FOREIGN PATENT DOCUMENTS

| | | | |
|---|---|---|---|
| EP | 1 788 588 | | 5/2007 |
| JP | 10-503807 | | 4/1998 |
| JP | 11-214207 | A | 8/1999 |
| JP | 2003-318014 | | 11/2003 |
| JP | 2005-15914 | | 1/2005 |
| JP | 2006-100813 | A | 4/2006 |
| WO | 96/02345 | | 2/1996 |
| WO | 02/080202 | A1 | 10/2002 |
| WO | 03/038843 | A1 | 5/2003 |
| WO | 2005/096324 | A1 | 10/2005 |
| WO | 2006/025430 | | 3/2006 |
| WO | WO 2006025430 | A1 * | 3/2006 |

OTHER PUBLICATIONS

Ozden, S., Charayev, A.M., Shaov, A.H., J. Mater. Sci., 1999, 34, 2741-2744.*
Extended European Search Report for European Application No. 077433851-1215, mailed on Dec. 30, 2009 (6 pages).
Japanese Office Action for Japanese Application No. 2006-150095, mailed on Jan. 27, 2009 (6 pages).
International Search Report w/translation from PCT/JP2007/059950 dated Jul. 24, 2007 (4 pages).
espacenet.com Abstract of JP2006-100813; Publication Date Apr. 13, 2006; Sumitomo Electric Industries and NOF Corp. (1 page).
espacenet.com Abstract of JP11-214207; Publication Date Aug. 6, 1999; Nichia Kagaku Kogyo KK (1 page).
PCT National Publication Gazette; JP10-503807; Publication Date Apr. 7, 1998; Hoganas AB (1 page).
Office Action for Japanese Application No. 2006-150095 mailed May 24, 2011, with English translation thereof (5 pages).
Japanese Office Action for Japanese Application No. 2006-150095, mailed on Apr. 28, 2009 (4 pages).
Patent Abstracts of Japan for Japanese Publication No. 2005-015914, Publication date Jan. 20, 2005 (1 page).
Patent Abstracts of Japan for Japanese Publication No. 2003-318014, Publication date Nov. 07, 2003 (1 page).
Office Action for Japanese Patent Application No. 2009-167003 mailed Sep. 6, 2011, with English translation thereof (6 pages).

* cited by examiner

*Primary Examiner* — Jim Goloboy
(74) *Attorney, Agent, or Firm* — Osha Liang LLP

(57) ABSTRACT

A soft magnetic material includes a plurality of composite magnetic particles including a metal magnetic particle and an insulating film surrounding a surface of the metal magnetic particle. The insulating film also contains a phosphate. The soft magnetic material further includes an aromatic polyetherketone resin and a metallic soap and/or an inorganic lubricant having a hexagonal crystal structure. The metallic soap and the inorganic lubricant are particles with an average particle size of not more than 2.0 μm.

1 Claim, 2 Drawing Sheets

SOFT MAGNETIC MATERIAL AND DUST CORE

TECHNICAL FIELD

The present invention generally relates to a soft magnetic material and a dust core, and more specifically to a soft magnetic material and a dust core including a plurality of metal magnetic particles each covered with an insulating film.

BACKGROUND ART

In these years, as the environmental regulations are tightened worldwide, automakers are each actively promoting developments in terms of lower emission and lower fuel consumption. Therefore, the conventional mechanical engine control mechanism is being replaced with an electronic engine control mechanism. Accordingly, it is required that a magnetic material which is a core part of the control mechanism has higher performance and a smaller size. In particular, developments are being promoted of a material having high magnetic properties in medium and high frequency ranges in order to achieve more precise control with smaller power. For a material to have high magnetic properties in medium and high frequency ranges, the material has to have all of high saturation flux density, high magnetic permeability and high electrical resistivity. While a metal magnetic material generally has high saturation flux density and high magnetic permeability, the metal magnetic material has a low electrical resistivity ($10^{-6}$ to $10^{-4}$ Ωcm) and thus has a large eddy current loss in middle and high frequency ranges. Therefore, the metal magnetic material has its magnetic properties deteriorated and thus is difficult to use singly. A metal oxide magnetic material has a higher electrical resistivity (1 to $10^{8}$ Ωcm) as compared with the metal magnetic material, and thus has a smaller eddy current loss in middle and high frequency ranges and less deterioration of its magnetic properties. However, since the saturation flux density of the metal oxide magnetic material is one-third to half that of the metal magnetic material, the use of the metal oxide magnetic material is limited. In view of these conditions, a composite magnetic material has been proposed that is a composite of a metal magnetic material and a metal oxide magnetic material and thus has high saturation flux density, high magnetic permeability and high electrical resistivity to compensate for respective defects of the metal magnetic material and the metal oxide magnetic material.

A composite magnetic material as described above is disclosed for example in Japanese National Patent Publication No. 10-503807 (Patent Document 1) that discloses a method of forming the composite magnetic material by joining, by means of an organic material such as polyphenyleneether, polyetherimide, amide oligomer, a plurality of composite magnetic particles that are each an iron particle with its surface covered with an iron phosphate film.

Patent Document 1: Japanese National Patent Publication No. 10-503807

DISCLOSURE OF THE INVENTION

Problems to be Solved by the Invention

In the case where the composite magnetic material is used for an engine control mechanism of an automobile, it is required that the composite magnetic material has thermal resistance in addition to the above-described magnetic properties since the temperature of the engine is high. However, the soft magnetic material disclosed in the above-described Patent Document 1 has a problem that the mechanical strength at high temperatures is insufficient.

The present invention therefore has been made for solving the above-described problem, and an object of the invention is to provide a soft magnetic material and a dust core having excellent flexural strength even at high temperatures.

Means for Solving the Problems

A soft magnetic material according to the present invention includes: a plurality of composite magnetic particles including a metal magnetic particle and an insulating film; an aromatic polyetherketone resin; and a metallic soap and/or an inorganic lubricant having a hexagonal crystal structure and the metallic soap and the inorganic lubricant are particles with an average particle size of not more than 2.0 μm.

Regarding the soft magnetic material, it was found that deterioration of the flexural strength particularly at high temperatures is suppressed in the case where the soft magnetic material includes an aromatic polyetherketone resin and a metallic soap and/or an inorganic lubricant having a hexagonal crystal structure that are particles with an average particle size of not more than 2.0 μm. In a heat treatment process at a temperature of not less than 400° C. and less than the pyrolysis temperature of the insulating film, the aromatic polyetherketone is melted once and re-solidified (crystallized) while being cooled. At this time, the inorganic lubricant in the form of fine particles with the average particle size of not more than 2.0 μm serves as a nucleating agent to promote crystallization. In the metallic soap, while an organic aliphatic chain is separated and eliminated in the heat treatment process, zinc or an inorganic zinc compound such as zinc oxide remains and serves as the nucleating agent. As the aromatic polyetherketone resin is crystallized, its structure becomes compact and the intermolecular force increases to improve thermal resistance and mechanical properties. Therefore, the thermal resistance and mechanical strength of the dust core in which the aromatic polyetherketone resin serves as a binder should also be improved.

Regarding the soft magnetic material, preferably the aromatic polyetherketone resin has a weight average molecular weight of not less than 10000 and not more than 100000. Since the weight average molecular weight is not more than 100000, the melt viscosity of the aromatic polyetherketone resin can be lowered. As a result, when the aromatic polyetherketone resin is melted in the heat treatment process, the aromatic polyetherketone resin easily spreads between the composite magnetic particles, and the metallic soap residue and/or the inorganic lubricant having a hexagonal crystal structure serving as a nucleating agent can be easily taken into the aromatic polyetherketone resin. Consequently, the mechanical characteristics of the soft magnetic material can be improved. Further, since the weight average molecular weight is not less than 10000, deterioration of the strength of the aromatic polyetherketone resin itself can be suppressed.

Regarding the soft magnetic material, preferably the aromatic polyetherketone resin has an average particle size that is not less than 10 times as large as the average particle size of the metallic soap and/or the inorganic lubricant having a hexagonal crystal structure and that is not more than twice as large as the average particle size of the metal magnetic particle. Since the average particle size is not less than 10 times as large as that of the metallic soap and/or inorganic lubricant having a hexagonal crystal structure, flowability of the metal magnetic particles can be prevented from lowering and hindrance of coating of the metallic soap and/or inorganic lubricant on the surface of the metal particle can be prevented. Since the average particle size is not more than twice as large as the average particle size of the metal magnetic particles, dispersion of the aromatic polyetherketone resin between composite magnetic particles can be maintained.

Regarding the soft magnetic material, preferably content of the metallic soap and/or the inorganic lubricant having a hexagonal crystal structure is not less than 0.001% by mass and not more than 0.1% by mass relative to the plurality of composite magnetic particles. Since the content is not less than 0.001% by mass, lubricity that suppresses damages to the insulating film can be further obtained from the metallic soap and/or the inorganic lubricant having a hexagonal crystal structure. In contrast, since the content is not more than 0.1% by mass, the magnetic flux density and the strength of the soft magnetic material can be further prevented from lowering.

A dust core according to the present invention is produced using any soft magnetic material as described above. With the dust core structured in the above-described manner, magnetic properties including a small core loss can be implemented while the dust core can have excellent flexural strength even at high temperatures.

Effects of the Invention

As explained above, with the soft magnetic material of the present invention, the dust core can be produced exhibiting magnetic properties including a small core loss while having excellent flexural strength even at high temperatures.

DESCRIPTION OF THE REFERENCE SIGNS

Figure 1:
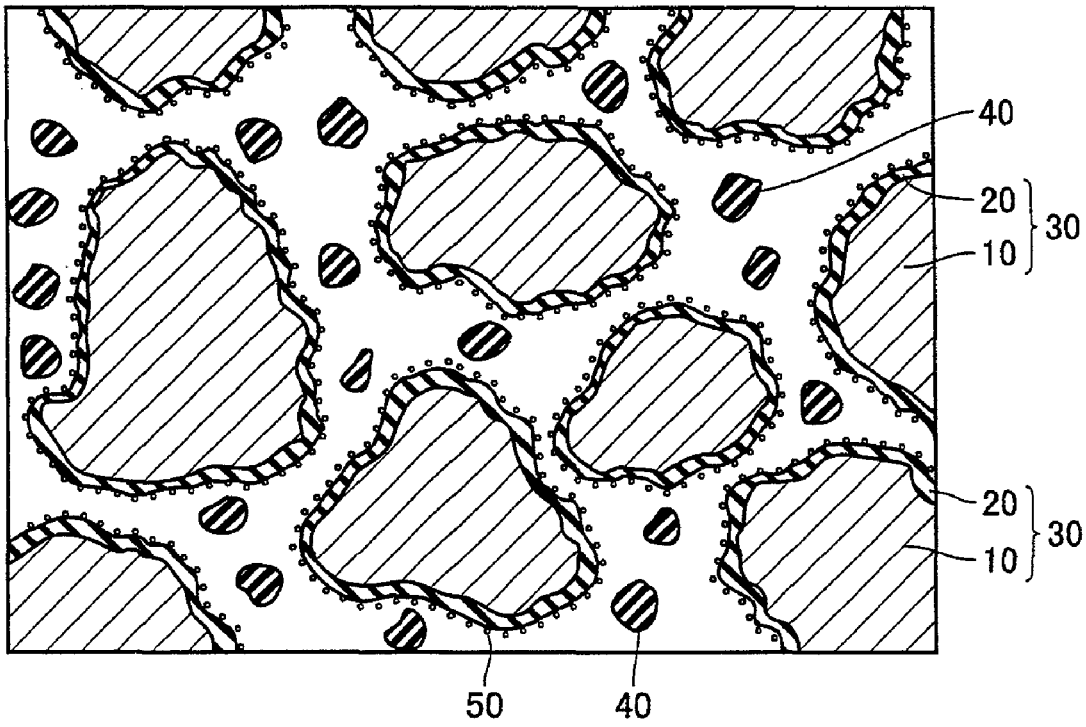
FIG. 1 schematically shows a soft magnetic material in an embodiment of the present invention.

10 metal magnetic particle, 20 insulating film, 30 composite magnetic particle, 40 aromatic polyetherketone resin, 50 metallic soap and/or inorganic lubricant having hexagonal crystal structure, 60 insulation

BEST MODES FOR CARRYING OUT THE INVENTION

An embodiment of the present invention will be hereinafter described with reference to the drawings. In the following drawings, like or corresponding components are denoted by like reference characters and a description thereof will not be repeated.

Embodiment

FIG. 1 schematically shows a soft magnetic material in an embodiment of the present invention. As shown in FIG. 1, the soft magnetic material in the embodiment includes a plurality of composite magnetic particles 30 each having a metal magnetic particle 10 and an insulating film 20 surrounding the surface of metal magnetic particle 10, an aromatic polyetherketone resin 40, and a metallic soap and/or an inorganic lubricant 50 having a hexagonal crystal structure, the metallic soap and the inorganic lubricant being particles with an average particle size of not more than 2.0 μm. Insulating film 20 includes a phosphate.

Figure 2:
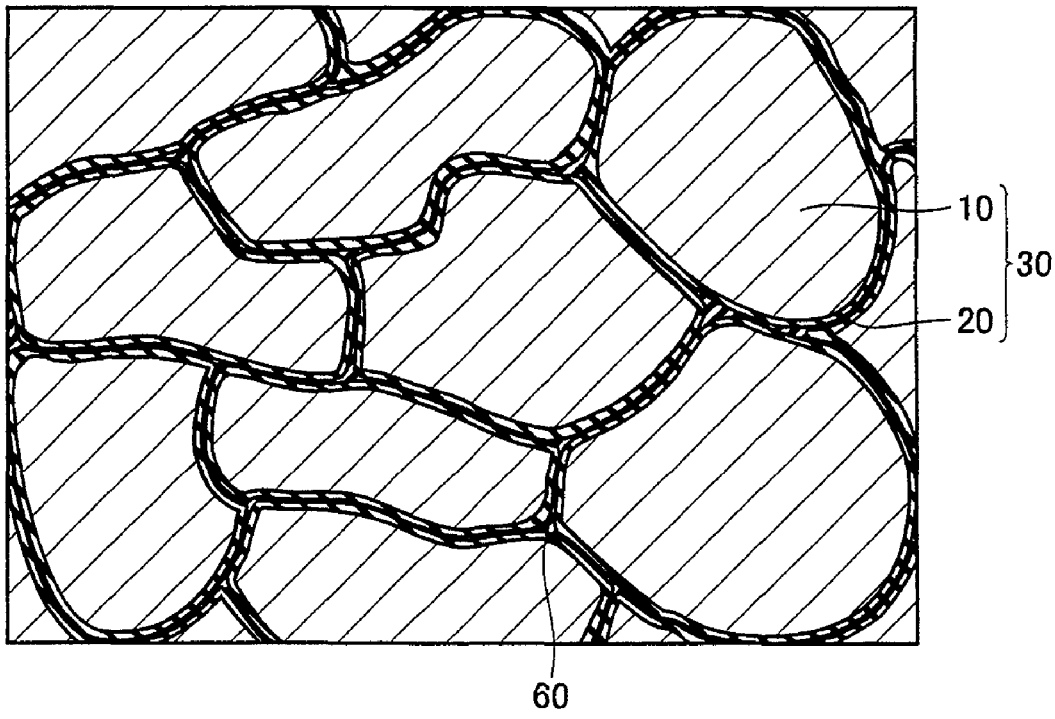
FIG. 2 is an enlarged cross section of a dust core in an embodiment of the present invention.

FIG. 2 is an enlarged cross section of a dust core in the embodiment of the present invention. The dust core in FIG. 2 is produced by pressure-molding and heat-treating the soft magnetic material in FIG. 1. As shown in FIG. 2, in the dust core of the present embodiment, a plurality of composite magnetic particles 30 are joined by aromatic polyetherketone resin 40 or joined by engagement of a protrusion and a depression of composite magnetic particles 30. As for an insulation 60, aromatic polyetherketone resin 40 or metallic soap and/or inorganic lubricant 50 or the like included in the soft magnetic material is converted into the insulation in the heat treatment process.

In the soft magnetic material and the dust core of the present invention, metal magnetic particle 10 is made of a material for example such as iron (Fe), iron (Fe)-aluminum (Al) alloy, iron (Fe)-silicon (Si) alloy, iron (Fe)-nitrogen (N) alloy, iron (Fe)-nickel (Ni) alloy, iron (Fe)-carbon (C) alloy, iron (Fe)-boron (B) alloy, iron (Fe)-cobalt (Co) alloy, iron (Fe)-phosphorus (P) alloy, iron (Fe)-nickel (Ni)-cobalt (Co) alloy, and iron (Fe)-aluminum (Al)-silicon (Si) alloy. Metal magnetic particle 10 may be a single metal or an alloy.

Metal magnetic particle 10 preferably has an average particle size of not less than 30 μm and not more than 500 μm. Since the average particle size of metal magnetic particle 10 is not less than 30 μm, the coercive force can be reduced. Since the average particle size is not more than 500 μm, the eddy current loss can be reduced. Further, deterioration of the compressibility of the powder mixture in the pressure molding process can be prevented. Thus, the density of the molded product obtained by the pressure molding does not decrease, and difficulty of handling can be avoided.

Here, the average particle size of metal magnetic particle 10 refers to the size of a particle obtained when the sum of masses of particles added in ascending order of particle size in a histogram of particle sizes reaches 50% of the total mass, that is, 50% particle size.

Insulating film 20 serves as an insulating layer between metal magnetic particles 10. The covering of metal magnetic particle 10 with insulating film 20 can increase electrical resistivity ρ of the dust core produced by pressure-molding the soft magnetic material. Thus, flow of the eddy current between metal magnetic particles 10 can be suppressed to reduce the eddy current loss of the dust core.

Insulating film 20 containing a phosphate is used. A metal oxide containing a phosphate can be used for insulating film 20 to further reduce the thickness of the coating layer covering the surface of the metal magnetic particle. Thus, the magnetic flux density of composite magnetic particle 30 can be increased and the magnetic properties are improved.

As the phosphate, in addition to an iron phosphate which is a phosphate of iron, manganese phosphate, zinc phosphate, calcium phosphate and aluminum phosphate for example may be used. The phosphate may be a composite metal salt of phosphoric acid such as iron phosphate doped with a small amount of aluminum. As oxide, silicon oxide, titanium oxide, aluminum oxide and zirconium oxide for example may be used.

Insulating film 20 made of an alloy of these metals may be used. Insulating film 20 may be formed as one layer as shown or as multiple layers.

Insulating film 20 preferably has an average thickness of not less than 0.005 μm and not more than 20 μm. More preferably, the average thickness of insulating film 20 is not less than 0.05 μm and not more than 0.1 μm. In the case where the average thickness of insulating film 20 is not less than 0.005 μm, electrical conduction due to tunnel effect can be suppressed. In the case where the average thickness of insulating film 20 is not less than 0.05 μm, electrical conduction due to tunnel effect can be effectively suppressed. In contrast, in the case where the average thickness of insulating film 20 is not more than 20 μm, shear fracture of insulating film 20 in the pressure molding process can be prevented. Further, since the ratio of insulating film 20 to the soft magnetic material is not excessively high, a considerable decrease of the magnetic flux density of the dust core obtained by pressure-molding the soft magnetic material can be prevented. In the case where the average thickness of insulating film 20 is not more than 0.1 μm, the magnetic flux density can be further prevented from decreasing.

Here, the average thickness is determined by deriving the corresponding thickness by taking into account the film composition obtained through composition analysis (TEM-EDX: transmission electron microscope energy dispersive X-ray spectroscopy) and the amount of elements obtained through inductively coupled plasma-mass spectrometry (ICP-MS), and further by directly observing the coating using TEM photography and confirming that the order of magnitude of the corresponding thickness previously derived is a proper value.

As aromatic polyetherketone resin 40, polyetheretherketone (PEEK), polyetherketone (PEK) or polyetherketoneketone for example may be used.

Preferably, the content of aromatic polyetherketone resin 40 with respect to a plurality of composite magnetic particles 30 is not less than 0.01% by mass and not more than 0.1% by mass. Since the content is not less than 0.01% by mass, the flexural strength of the soft magnetic material and the dust core can be improved. In contrast, since the content is not more than 0.1% by mass, the content of a nonmagnetic layer in the soft magnetic material and the dust core is limited so that the magnetic flux density can be further prevented from decreasing.

As for metallic soap and/or inorganic lubricant 50 having a hexagonal crystal structure that are particles with an average particle size of not more than 2.0 μm, the metallic soap may be zinc stearate, lithium stearate, calcium stearate, lithium palmitate, calcium palmitate, lithium oleate, calcium oleate or the like. The inorganic lubricant having a hexagonal crystal structure may be boron nitride, molybdenum disulfide, tungsten disulfide, graphite or the like.

The content of metallic soap and/or inorganic lubricant 50 having a hexagonal crystal structure that are particles with an average particle size of not more than 2.0 μm, with respect to a plurality of composite magnetic particles, is preferably not less than 0.001% by mass and not more than 0.1% by mass. The content of not less than 0.001% by mass can provide good lubricity obtained from the metallic soap and/or inorganic lubricant having a hexagonal crystal structure to prevent damages to the insulating film. The content of not more than 0.1% by mass can further prevent the magnetic flux density and the strength of the soft magnetic material from decreasing. The average particle size of metallic soap and/or inorganic lubricant 50 having a hexagonal crystal structure is preferably not more than 0.8 μm. The average particle size of not more than 0.8 μm can further reduce damages to insulating film 20 when the soft magnetic material is made compact and thus the core loss can further be decreased.

The average particle size of metallic soap and/or inorganic lubricant 50 having a hexagonal crystal structure refers to the size of a particle obtained when the sum of masses of particles added in ascending order of particle size in a histogram of particle sizes as measured by laser scattering diffraction reaches 50% of the total mass, namely 50% particle size.

The average particle size of the soft magnetic material is preferably not less than 5 μm and not more than 200 μm. Since the particle size is not less than 5 μm, the powder compressibility decreases and the magnetic flux density decreases. Since the particle size is not more than 200 μm, the eddy current loss of the composite magnetic particles can be reduced particularly when used in the range of 1 kHz to 10 kHz.

Figure 3:
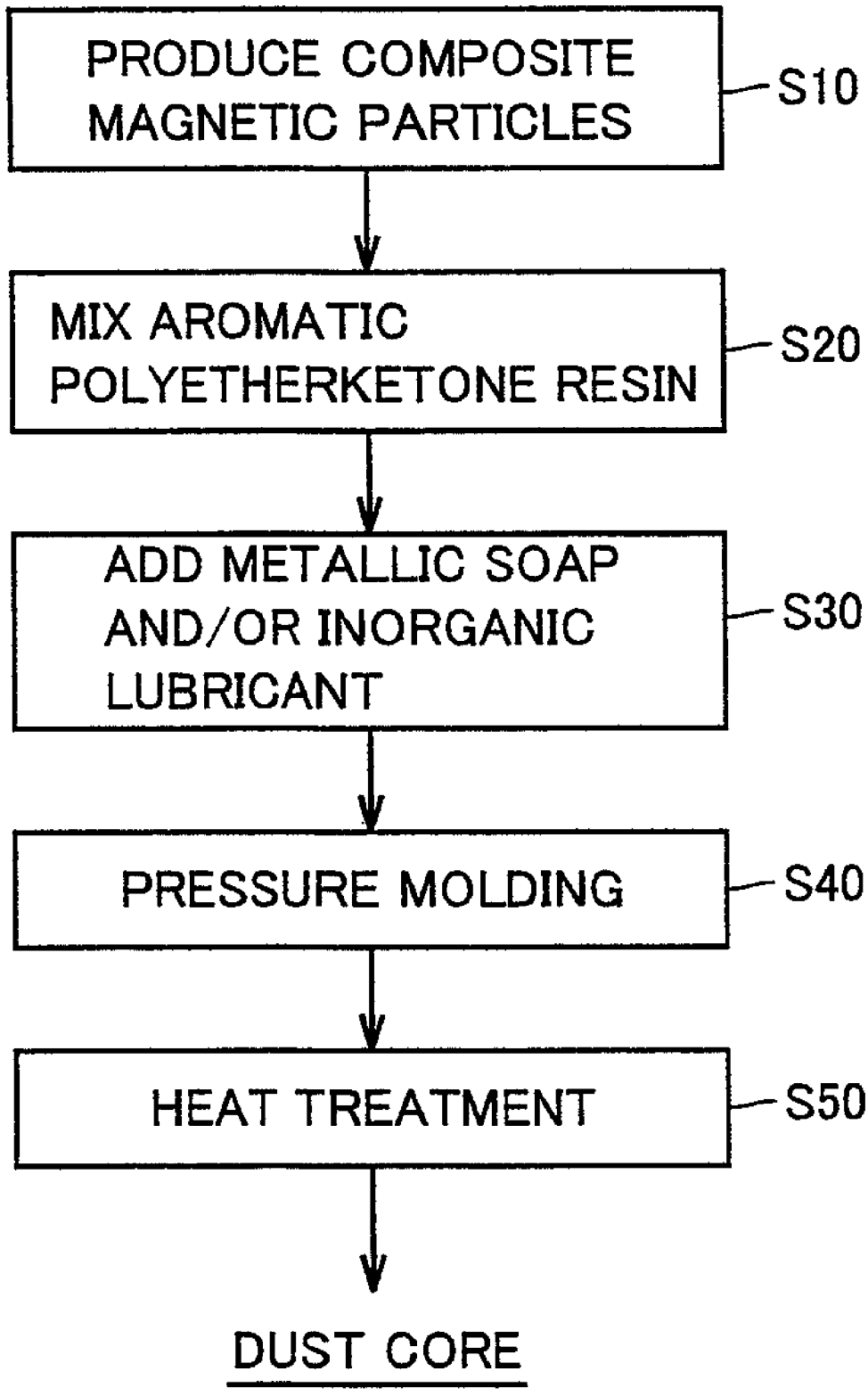
FIG. 3 is a flowchart showing successive steps of a method of manufacturing a dust core in an embodiment of the present invention.

A method of manufacturing the soft magnetic material shown in FIG. 1 and the dust core shown in FIG. 2 will be described with reference to FIGS. 1 to 3. FIG. 3 is a flowchart showing successive steps of the method of manufacturing a dust core in the embodiment of the present invention.

As shown in FIG. 3, the step of producing composite magnetic particles 30 (S10) is performed first. This step (S10) is specifically performed in the following manner. Metal magnetic particles 10 are prepared. Then, metal magnetic particles 10 are heat-treated at a temperature of not less than 400° C. and not more than 900° C. for example. Insulating film 20 is thus formed on the surface of each metal magnetic particle 10. Insulating film 20 can be formed by phosphating metal magnetic particles 10 for example. Accordingly, a plurality of composite magnetic particles 30 are obtained.

Insulating film 20 can be formed by phosphating metal magnetic particles 10 for example. The phosphating process forms insulating film 20 made of for example iron phosphate containing phosphorus and iron, or aluminum phosphate, silicon phosphate, magnesium phosphate, calcium phosphate, yttrium phosphate, zirconium phosphate or the like. For forming the insulating film of these phosphates, solvent spraying or sol-gel process using a precursor may be used. Alternatively, insulating film 20 made of an organic silicon compound may be formed. For forming this insulating film, wet coating using an organic solvent or direct coating using a mixer for example may be used.

Next, the step of mixing a plurality of composite magnetic particles 30 with an aromatic polyetherketone resin (S20) is performed. In this step (S20), the method of mixing them is not particularly limited, and any of such methods as mechanical alloying, vibration ball mill, planetary ball mill, mechanofusion, coprecipitation, chemical vapor deposition (CVD), physical vapor deposition (PVD), plating, sputtering, vapor deposition or sol-gel method for example may be used.

Then, the step of adding metallic soap and/or inorganic lubricant 50 having a hexagonal crystal structure that are particles with an average particle size of not more than 2.0 μm (S30) is performed. In this step (S30), a predetermined ratio of metallic soap and/or inorganic lubricant 50 is added to composite magnetic particles 30, and they are mixed together using a V-shaped mixer and accordingly the soft magnetic material in the present embodiment is completed. Here, the method of mixing is not particularly limited.

Through the above-described steps (S10-S30), the soft magnetic material in the embodiment shown in FIG. 1 is obtained. In order to produce the dust core as shown in FIG. 2, the following steps are further performed.

The step of pressure molding the obtained soft magnetic material (S40) is performed. In this step (S40), the obtained soft magnetic material is placed in a mold and is pressure-molded with a pressure of 700 MPa to 1500 MPa for example. Accordingly, the soft magnetic material is compressed into a molded product. The ambient of the pressure molding is preferably an inert gas ambient or reduced-pressure ambient. In this case, oxidization of composite magnetic particles 30 by the oxygen in the atmosphere can be suppressed.

In the pressure molding process, metallic soap and/or inorganic lubricant 50 having a hexagonal crystal structure that are in the form of particles with an average particle size of not more than 2 μm is provided between composite magnetic particles 30 adjacent to each other. Accordingly, composite magnetic particles 30 are prevented from rubbing hard each other. At this time, since metallic soap and/or inorganic lubricant 50 show excellent lubricity, insulating film 20 provided on the outer surface of composite magnetic particle 30 is not broken. In this way, the state in which insulating film 20 covers the surface of metal magnetic particle 10 can be maintained, and it can be ensured that insulating film 20 serves as an insulating layer between metal magnetic particles 10.

The step of performing heat treatment (S50) is performed next. In this step (S50), the molded product obtained by the pressure molding is heat-treated at a temperature of not less than 400° C. and less than the pyrolysis temperature of insulating film 20. Thus, distortion and dislocation present in the molded product are removed. At this time, since the heat treatment is performed at a temperature less than the pyrolysis temperature of insulating film 20, the heat treatment does not deteriorate insulating film 20. Further, the heat treatment converts aromatic polyetherketone resin 40 and metallic soap and/or inorganic lubricant 50 having a hexagonal crystal structure that are particles with an average particle size of not more than 2.0 μm into insulation 60.

After the heat treatment, the molded product undergoes appropriate processes such as extrusion and cutting and thus the dust core shown in FIG. 2 is completed.

The dust core produced through the above-described steps (S10-S50) and shown in FIG. 2 preferably has a packing fraction of not less than 95%. The packing fraction of the dust core is determined by dividing the actually measured density of the dust core including insulating film 20, aromatic polyetherketone resin 40, metallic soap and/or inorganic lubricant 50 having a hexagonal crystal structure that are particles with an average particle size of not more than 2.0 μm, and voids between composite magnetic particles 30, by a theoretical density of metal magnetic particles 10. Although the theoretical density of metal magnetic particles 10 is not determined in consideration of insulating film 20, aromatic polyetherketone resin 40 and metallic soap and/or inorganic lubricant 50 having a hexagonal crystal structure that are particles with an average particle size of not more than 2.0 μm, the ratio of them to the whole is extremely small. Therefore, the above-described method can be used to obtain a value very close to the actual packing fraction. In the case where metal magnetic particles 10 are made of an alloy, specifically in the case where metal magnetic particles 10 are made of an iron-cobalt alloy for example, the theoretical density of metal magnetic particles 10 can be determined using the following formula:

(theoretical density of iron×volume ratio of iron relative to metal magnetic particles 10)+(theoretical density of cobalt×volume ratio of cobalt relative to metal magnetic particles 10).

As heretofore described, the soft magnetic material in the embodiment of the present invention includes a plurality of composite magnetic particles 30 each having metal magnetic particle 10 and insulating film 20 surrounding the surface of metal magnetic particle 10 and containing a phosphate, aromatic polyetherketone resin 40, and metallic soap and/or inorganic lubricant 50 having a hexagonal crystal structure that are particles with an average particle size of not more than 2.0 μm. Since aromatic polyetherketone resin 40 is included as a binder resin, the soft magnetic material can have improved mechanical characteristics through heat treatment.

Further, since metallic soap and/or inorganic lubricant 50 having a hexagonal crystal structure that are particles with an average particle size of not more than 2.0 μm is included, the inorganic lubricant can be prevented from being deteriorated or softened in the heat treatment process. Therefore, the eddy current loss is sufficiently reduced and deterioration of the core loss can be prevented.

The dust core in the embodiment of the present invention is produced by pressure molding the soft magnetic material. Therefore, the dust core having excellent characteristics that the magnetic flux density is not less than 16 kG and the electrical resistivity is not less than $10^{-3}$ Ωcm and not more than $10^{2}$ Ωcm when a magnetic field of not less than 12000 A/m is applied, and the core loss value is not more than 1500 dW/$m^3$ when a full loop (BH curve) is drawn with an exciting flux density of 2.5 kG and a measurement frequency of 5 kHz, and the flexural strength at 200° C. is not less than 100 MPa. Here, the flexural strength (bending strength) is measured based on the common metal material test method defined by JIS (Japanese Industrial Standards) Z2238.

Example 1

In this example, effects of the soft magnetic material and the dust core of the present invention were examined. First, with reference to Table 1 and Table 2 below, respective dust cores of Examples 1 to 12 of the present invention and Comparative Examples 1 to 5 were produced by the following methods.

TABLE 1

| | | | | | lubricant | | | binder | | | |
|---|---|---|---|---|---|---|---|---|---|---|---|
| | metal magnetic particles | insulating film (estimated thickness) | molding pressure [MPa] | heat treatment conditions | type | average particle size [μm] | added amount [wt %] | type | average molecular weight | average particle size [μm] | added amount [wt %] |
| Example 1 | ABC100.30 | phosphate (100 nm) | 1275 | 420° C., 1 h, $N_2$ | zinc stearate | 0.8 | 0.005 | PEEK | 43000 | 100 | 0.05 |
| Example 2 | ABC100.30 | phosphate (100 nm) | 1275 | 420° C., 1 h, $N_2$ | hBN | 2.0 | 0.005 | PEEK | 43000 | 100 | 0.05 |
| Example 3 | ABC100.30 | phosphate (100 nm) | 1275 | 420° C., 1 h, $N_2$ | $MoS_2$ | 2.0 | 0.005 | PEEK | 43000 | 100 | 0.05 |
| Example 4 | ABC100.30 | phosphate (100 nm) | 1275 | 420° C., 1 h, $N_2$ | graphite | 2.0 | 0.005 | PEEK | 43000 | 100 | 0.05 |
| Example 5 | ABC100.30 | phosphate (100 nm) | 1275 | 420° C., 1 h, $N_2$ | zinc stearate | 0.8 | 0.001 | PEEK | 43000 | 100 | 0.05 |
| Example 6 | ABC100.30 | phosphate (100 nm) | 1275 | 420° C., 1 h, $N_2$ | zinc stearate | 0.8 | 0.050 | PEEK | 43000 | 100 | 0.05 |

TABLE 1-continued

| | metal magnetic particles | insulating film (estimated thickness) | molding pressure [MPa] | heat treatment conditions | lubricant type | lubricant average particle size [μm] | lubricant added amount [wt %] | binder type | binder average molecular weight | binder average particle size [μm] | binder added amount [wt %] |
|---|---|---|---|---|---|---|---|---|---|---|---|
| Example 7 | ABC100.30 | phosphate (100 nm) | 1275 | 420° C., 1 h, $N_2$ | zinc stearate | 0.8 | 0.005 | PEEK | 109000 | 100 | 0.05 |
| Example 8 | ABC100.30 | phosphate (100 nm) | 1275 | 420° C., 1 h, $N_2$ | zinc stearate | 0.8 | 0.005 | PEEK | 43000 | 300 | 0.05 |
| Example 9 | ABC100.30 | phosphate (100 nm) | 1275 | 420° C., 1 h, $N_2$ | zinc stearate | 0.8 | 0.005 | PEEK | 10000 | 100 | 0.05 |
| Example 10 | ABC100.30 | phosphate (100 nm) | 1275 | 420° C., 1 h, $N_2$ | zinc stearate | 0.8 | 0.005 | PEEK | 100000 | 100 | 0.05 |
| Example 11 | ABC100.30 | phosphate (100 nm) | 1275 | 420° C., 1 h, $N_2$ | zinc stearate | 2.0 | 0.005 | PEEK | 43000 | 200 | 0.05 |
| Example 12 | ABC100.30 | phosphate (100 nm) | 1275 | 420° C., 1 h, $N_2$ | zinc stearate | 0.8 | 0.1 | PEEK | 43000 | 100 | 0.05 |

Example: Example of the present invention

TABLE 2

| | metal magnetic particles | insulating film (estimated thickness) | molding pressure [MPa] | heat treatment conditions | lubricant type | lubricant average particle size [μm] | lubricant added amount [wt %] | binder type | binder average molecular weight | binder average particle size [μm] | binder added amount [wt %] |
|---|---|---|---|---|---|---|---|---|---|---|---|
| C. Example 1 | ABC100.30 | phosphate (100 nm) | 1275 | 420° C., 1 h, $N_2$ | zinc stearate | 0.8 | 0.005 | PPS | — | 100 | 0.05 |
| C. Example 2 | ABC100.30 | phosphate (100 nm) | 1275 | 420° C., 1 h, $N_2$ | zinc stearate | 0.8 | 0.005 | PEI | — | 100 | 0.05 |
| C. Example 3 | ABC100.30 | phosphate (100 nm) | 1275 | 420° C., 1 h, $N_2$ | zinc stearate | 7.5 | 0.005 | PEEK | 43000 | 100 | 0.05 |
| C. Example 4 | ABC100.30 | phosphate (100 nm) | 1275 | 420° C., 1 h, $N_2$ | ethylenebis stearic acid amide | — | 0.005 | PEEK | 43000 | 100 | 0.05 |
| C. Example 5 | ABC100.30 | phosphate (100 nm) | 1275 | 420° C., 1 h, $N_2$ | — | — | — | PEEK | 43000 | 100 | 0.05 |

C. Example: Comparative Example

<Fabrication of Dust Core in Example 1 of the Invention>

As the metal magnetic particles, pure iron powder (product name "ABC100.30" manufactured by Hoganas Japan K.K., average grain size 100 μm) was prepared. The surface of the powder was phosphated to form an insulating film made of an iron phosphate and having an average thickness of 100 nm. As the aromatic polyetherketone resin, 0.05% by mass of PEEK (manufactured by Victrex-MC Inc., average particle size 100 μm, weight average molecular weight 43000) was added relative to a plurality of composite magnetic particles. As the metallic soap and/or the inorganic lubricant having a hexagonal crystal structure that were particles with an average particle size of not more than 2.0 μm, 0.005% by mass of a zinc stearate (manufactured by NOF corporation, average particle size 0.8 μm) having an average particle size of 0.8 μm was added relative to a plurality of composite magnetic particles. A V-shaped mixer was used to mix these components for one hour to prepare the soft magnetic material in Example 1 of the invention. After this, to the soft magnetic material, a pressure of 1275 MPa was added to produce a molded product. Then, in a nitrogen air flow ambient at 420° C., the molded product was heat-treated for one hour. In this way, the dust core was fabricated.

<Fabrication of Dust Core in Example 2 of the Invention>

While Example 2 of the invention is basically similar to Example 1, Example 2 differs from Example 1 only in that hexagonal boron nitride (hBN, manufactured by Mizushima Ferroalloy Co., Ltd., average particle size 2 μm) was used as the metallic soap and/or the inorganic lubricant having a hexagonal crystal structure that were particles with an average particle size of not more than 2.0 μm.

<Fabrication of Dust Core in Example 3 of the Invention>

While Example 3 of the invention is basically similar to Example 1, Example 3 differs from Example 1 only in that molybdenum disulfide (MoS, manufactured by Sumico Lubricant Co., Ltd., average particle size 1 μm) was used as the metallic soap and/or the inorganic lubricant having a hexagonal crystal structure that were particles with an average particle size of not more than 2.0 μm.

<Fabrication of Dust Core in Example 4 of the Invention>

While Example 4 of the invention is basically similar to Example 1, Example 4 differs from Example 1 only in that a graphite was used as the metallic soap and/or the inorganic lubricant having a hexagonal crystal structure that were particles with an average particle size of not more than 2.0 μm.

<Fabrication of Dust Core in Example 5 of the Invention>

While Example 5 of the invention is basically similar to Example 1, Example 5 differs from Example 1 only in that a metallic soap and/or an inorganic lubricant having a hexagonal crystal structure that were particles with an average particle size of not more than 2.0 μm was added by 0.001% by mass.

<Fabrication of Dust Core in Example 6 of the Invention>

While Example 6 of the invention is basically similar to Example 1, Example 6 differs from Example 1 only in that a metallic soap and/or an inorganic lubricant having a hexagonal crystal structure that were particles with an average particle size of not more than 2.0 μm was added by 0.050% by mass.

<Fabrication of Dust Core in Example 7 of the Invention>

While Example 7 of the invention is basically similar to Example 1, Example 7 differs from Example 1 only in that PEEK (manufactured by Victrex-MC Inc.) having a weight average molecular weight of 109000 was used as the aromatic polyetherketone resin.

<Fabrication of Dust Core in Example 8 of the Invention>

While Example 8 of the invention is basically similar to Example 1, Example 8 differs from Example 1 only in that PEEK (manufactured by Victrex-MC Inc.) having an average particle size of 300 μm was used as the aromatic polyetherketone resin.

<Fabrication of Dust Core in Example 9 of the Invention>

While Example 9 of the invention is basically similar to Example 1, Example 9 differs from Example 1 only in that PEEK having a weight average molecular weight of 10000 was used.

<Fabrication of Dust Core in Example 10 of the Invention>

While Example 10 of the invention is basically similar to Example 1, Example 10 differs from Example 1 only in that PEEK having a weight average molecular weight of 100000 was used.

<Fabrication of Dust Core in Example 11 of the Invention>

While Example 11 of the invention is basically similar to Example 1, Example 11 differs from Example 1 only in that PEEK having its average particle size of not less than 10 times as large as that of the inorganic lubricant and that is twice as large as the metal magnetic particles was used.

<Fabrication of Dust Core in Example 12 of the Invention>

While Example 12 of the invention is basically similar to Example 1, Example 12 differs from Example 1 only in that an inorganic lubricant of 0.1% by mass contained relative to a plurality of composite magnetic particles was used.

<Fabrication of Dust Core in Comparative Example 1>

While Comparative Example 1 is basically similar to Example 1 of the invention, Comparative Example 1 differs from Example 1 only in that polyphenylene sulfide (PPS, manufactured by Idemitsu Petrochemical Co., Ltd.) was used instead of the aromatic polyetherketone resin.

<Fabrication of Dust Core in Comparative Example 2>

While Comparative Example 2 is basically similar to Example 1 of the invention, Comparative Example 2 differs from Example 1 only in that polyetherimide (PEI, manufactured by GE Plastic) that is an amorphous resin was used instead of the aromatic polyetherketone resin.

<Fabrication of Dust Core in Comparative Example 3>

While Comparative Example 3 is basically similar to Example 1 of the invention, Comparative Example 3 differs from Example 1 only in that zinc stearate (manufactured by NOF Corporation) having an average particle size of 7.5 μm was used instead of the metallic soap and/or the inorganic lubricant having a hexagonal crystal structure that were particles with an average particle size of not more than 2.0 μm.

<Fabrication of Dust Core in Comparative Example 4>

While Comparative Example 4 is basically similar to Example 1 of the invention, Comparative Example 4 differs from Example 1 only in that ethylenebisstearic acid amide (manufactured by NOF Corporation) was used instead of the metallic soap and/or the inorganic lubricant having a hexagonal crystal structure that were particles with an average particle size of not more than 2.0 μm.

<Fabrication of Dust Core in Comparative Example 5>

While Comparative Example 5 is basically similar to Example 1 of the invention, Comparative Example 5 differs from Example 1 only in that the metallic soap and/or the inorganic lubricant having a hexagonal crystal structure that were particles with an average particle size of not more than 2.0 μm was not added.

<Measurement of Core Loss>

For the above-described dust cores each, a ring-shaped molded product (having been heat-treated) with an outer diameter of 34 mm, an inner diameter of 20 mm and a thickness of 5 mm was provided with a primary winding of 300 turns and a secondary winding of 20 turns to produce a sample to be used for measuring magnetic properties. With these samples, a BH curve tracer (product name "BHS-40S10K" manufactured by Riken Denshi Co., Ltd.) was used to measure the core loss. Specifically, the magnetic flux density when a magnetic field of 12000 A/m was applied was measured first. Under the conditions that an excitation flux density was 2.5 kG (=0.25 T (tesla)) and the measurement frequency was 5 kHz, a full loop (BH curve) was drawn. The core loss at this time was measured. The results of measurement are represented as core loss value ($W/m^3$) per unit volume, and the measurement results are shown in Table 3.

<Measurement of Flexural Strength>

A specimen for testing three-point bending flexural strength having a size of 10 mm×10 mm×55 mm was fabricated. Using the specimen for the three-point bending flexural strength test, a three-point bending flexural strength test was conducted using a universal material tester autograph (product name "TG-25" manufactured by Shimazu Corporation). The three-point bending flexural strength test was conducted at room temperature and 200° C. while supporting the specimen over a span of 40 mm. The results of measurement are shown in Table 3.

TABLE 3

| sample | core loss [$kW/m^3$] | 3-point bending flexural strength [MPa] RT | 200° C. |
|---|---|---|---|
| Example 1 | 1109 | 140.1 | 121.6 |
| Example 2 | 1296 | 163.8 | 137.3 |
| Example 3 | 1325 | 162.1 | 132.9 |
| Example 4 | 1371 | 154.7 | 128.8 |
| Example 5 | 1413 | 143.8 | 117.2 |
| Example 6 | 1092 | 135.6 | 109.3 |
| Example 7 | 1205 | 133.6 | 106.5 |
| Example 8 | 1274 | 128.5 | 108.7 |
| Example 9 | 1142 | 137.7 | 115.4 |
| Example 10 | 1187 | 133.5 | 112.1 |
| Example 11 | 1261 | 135.6 | 109.5 |
| Example 12 | 987 | 128.8 | 105.4 |
| C. Example 1 | 1153 | 118.0 | 96.7 |
| C. Example 2 | 1135 | 121.7 | 93.4 |
| C. Example 3 | 1744 | 128.4 | 98.2 |
| C. Example 4 | 1420 | 95.3 | 67.4 |
| C. Example 5 | 1866 | 132.5 | 97.1 |

Example: Example of the present invention
C. Example: Comparative Example

As shown in Table 3, respective dust cores in Examples 1 to 12 of the present invention including an aromatic polyetherketone resin and at least one of a metallic soap and an inorganic lubricant having a hexagonal crystal structure that are particles with an average particle size of not more than 2.0 μm maintain a low core loss and show a high flexural strength. In particular, of Examples 1 to 6 and 9 to 12 of the present invention in which the weight average molecular weight of the aromatic polyetherketone resin is not less than 10000 and not more than 100000, the average particle size of the aromatic polyetherketone resin is not less than 10 times as large as the average particle size of the metallic soap and/or inorganic lubricant having a hexagonal crystal structure and not more than twice as large as the average particle size of the metal magnetic particles, and the metallic soap and/or the inorganic lubricant having a hexagonal crystal structure is contained by not less than 0.001% by mass and not more than 0.1% by mass relative to a plurality of composite magnetic particles, Examples 1 to 6 and 9 to 11 of the invention exhibit highly excellent flexural strength at a high temperature of 200° C., and Example 12 of the invention exhibits a considerably low core loss.

In contrast, respective dust cores of Comparative Example 1 using PPS and Comparative Example 2 using PEI instead of the aromatic polyetherketone resin can be prevented from being deteriorated in terms of core loss, while the flexural strength at room temperature and 200° C. is low.

Further, the dust core of Comparative Example 3 using a metallic soap (manufactured by NOF Corporation) having an average particle size of 7.5 μm instead of the metallic soap and/or the inorganic lubricant having a hexagonal crystal structure that are particles with an average particle size of not more than 2.0 μm has a low flexural strength at room temperature and 200° C.

Further, the dust core of Comparative Example 4 using ethylenebisstearic acid amide instead of the metallic soap and/or the inorganic lubricant having a hexagonal crystal structure that are particles with an average particle size of not more than 2.0 μm has a considerably low flexural strength at room temperature and 200° C.

Further, the dust core of Comparative Example 5 without adding thereto a metallic soap and/or inorganic lubricant having a hexagonal crystal structure that are particles with an average particle size of not more than 2.0 μm has a considerably deteriorated core loss.

As heretofore discussed, it has been found that Example 1 including an aromatic polyetherketone resin and at least one of a metallic soap and an inorganic lubricant having a hexagonal crystal structure that are particles with an average particle size of not more than 2.0 μm does not have an increased core loss and has an improved flexural strength.

It should be construed that embodiments and examples disclosed herein are by way of illustration in all respects, not by way of limitation. It is intended that the scope of the present invention is defined by claims, not by the embodiments and examples above, and includes all modifications and variations equivalent in meaning and scope to the claims.

INDUSTRIAL APPLICABILITY

The soft magnetic material and the dust core of the present invention are used for automobile engine-related devices, motor core, solenoid valve, reactor or generally for electromagnetic parts, for example.

The invention claimed is:

1. A dust core comprising:

a plurality of composite magnetic particles including a metal magnetic particle of pure iron and an insulating film surrounding a surface of said metal magnetic particle and containing a phosphate;

an aromatic polyetheretherketone resin; and a metallic soap and/or an inorganic lubricant having a hexagonal crystal structure, said metallic soap and said inorganic lubricant being particles with an average particle size of not more than 2.0 μm, wherein content of said metallic soap and/or said inorganic lubricant having a hexagonal crystal structure is not less than 0.001% by mass and not more than 0.05% by mass relative to said plurality of composite magnetic particles, said aromatic polyetheretherketone resin has a weight average molecular weight of not less than 10000 and not more than 100000, said aromatic polyetheretherketone resin has an average particle size that is not less than 10 times as large as the average particle size of said metallic soap and/or said inorganic lubricant having a hexagonal crystal structure and that is not more than twice as large as an average particle size of said metal magnetic particle, and said dust core has a flexural strength at 200° C. of not less than 109.3 MPa.

* * * * *

UNITED STATES PATENT AND TRADEMARK OFFICE

CERTIFICATE OF CORRECTION

PATENT NO. : 8,241,518 B2
APPLICATION NO. : 12/300893
DATED : August 14, 2012
INVENTOR(S) : Naoto Igarashi et al.

It is certified that error appears in the above-identified patent and that said Letters Patent is hereby corrected as shown below:

On the Title Page

- Under Item (56) References Cited - Other Publications, line 4, European Application Number is listed as "077433851-1215" and it should read --07743385.2-1215--.

Signed and Sealed this
Nineteenth Day of February, 2013

Teresa Stanek Rea
*Acting Director of the United States Patent and Trademark Office*